US005690167A

United States Patent [19]

Rieger

[11] Patent Number: 5,690,167

[45] Date of Patent: Nov. 25, 1997

[54] INNER RIBBED TUBE OF HARD METAL AND METHOD

[75] Inventor: Klaus K. Rieger, St. Simons Island, Ga.

[73] Assignee: High Performance Tube, Inc., Warren, N.J.

[21] Appl. No.: 670,010

[22] Filed: Jun. 25, 1996

Related U.S. Application Data

[63] Continuation-in-part of Ser. No. 349,613, Dec. 5, 1994, abandoned.

[51] Int. Cl.[6] ..... F28F 1/42

[52] U.S. Cl. ..... 165/133; 165/179; 165/184

[58] Field of Search ..... 165/133, 179, 165/184

[56] References Cited

U.S. PATENT DOCUMENTS

| | | | |
|---|---|---|---|
| 3,523,577 | 8/1970 | Milton | 165/133 X |
| 3,847,212 | 11/1974 | Withers, Jr. et al. | 165/179 |
| 4,366,859 | 1/1983 | Keyes | 165/184 |
| 4,938,282 | 7/1990 | Zohler | 165/133 |

FOREIGN PATENT DOCUMENTS

| | | | |
|---|---|---|---|
| 2043459 | 3/1972 | Germany | 165/133 |
| 125592 | 6/1986 | Japan | 165/179 |
| 265499 | 11/1986 | Japan | 165/179 |
| 1341483 | 9/1987 | U.S.S.R. | 165/181 |

*Primary Examiner*—Leonard R. Leo
*Attorney, Agent, or Firm*—Richard T. Laughlin; Graham, Curtin & Sheridan

[57] ABSTRACT

A heat exchanger inner spiral-ribbed tube made of a hard metal such as stainless steel, titanium, or an iron-nickel alloy, and method of manufacture therefor for use in making a heat exchanger. The tube has an annular wall having an inner ribbed surface and an outer waved surface. The inner surface has a plurality of inner spiral ribs, each having a spiral angle. The spiral angle is about 18 degrees in the described embodiment. The tube-making method includes multiple steps in forming the outer waves and inner ribs simultaneously, progressively increasing the rib height while continuously pulling the tube in an axial direction.

4 Claims, 3 Drawing Sheets

INNER RIBBED TUBE OF HARD METAL AND METHOD

BACKGROUND OF THE INVENTION

This application is a continuation-in-part of U.S. patent application Ser. No. 08/349,613 filed Dec. 5, 1994, now abandoned. Reference is made to U.S. Pat. No. 5,219,374 issued Jun. 15, 1993 to John M. Keyes relating to welded tube, and U.S. Pat. No. 4,951,742 issued Aug. 28, 1990 to John M. Keyes relating to exterior firming of hard metal tubing. Another prior art inner spiral-ribbed tube is described in U.S. Pat. No. 4,705,103 issued Nov. 10, 1987. Related prior art references include U.S. Pat. Nos.:

| | | |
|---|---|---|
| 2,167,933, | issued | February 8, 1938, |
| 3,273,599, | issued | September 20, 1966, |
| 3,753,364, | issued | August 21, 1973, |
| 3,768,291, | issued | October 30, 1973, |
| 3,861,462, | issued | January 21, 1975, |
| 4,118,944, | issued | October 10, 1978, |
| 4,154,296, | issued | May 15, 1979, |
| 4,658,892, | issued | April 21, 1987, |
| 4,660,630, | issued | April 28, 1987, |
| 4,938,282, | issued | July 3, 1990, |

and also include a related prior art article appearing in TPQ/Winter 1990 entitled "New Methods in ID Finned Tubing for High Nickel Alloys," by Tassen, et al. (employees of Inco Alloys International, Inc., Huntington, W. Va.), and a reference paper, which was presented in Atlanta, Ga., USA, at the ITA Meeting that was held on Oct. 15, 1984, entitled "Internally Grooved Tubes for Air Conditioners," and which explains a prior art method of manufacture.

FIELD OF THE INVENTION

The invention generally relates to an inner ribbed tube and method wherein the tube is formed from a hard metal and, in particular, the invention relates to a heat exchanger with an inner spiral-ribbed, outer spiral-waved tube and method of manufacture therefor.

In a first prior art method of manufacture, the inner spiral-ribbed tube is made by forming the groves and fins in the flat a metal by metal forming processes and then bending the flat metal into the form of a tube and welding the seam. One problem with this first prior art method is that this product produces a flat portion at the seam. A second prior art method of manufacture includes the forming of the grooves in the exterior of the tube after it is in the shape of a tube. This forming step, as shown in U.S. Pat. No. 3,768,291, is very difficult to accomplish with hard metal tubes for making inner ribbed, outer waved tubes.

The second prior art method of making the outer spiral-ribbed tube includes the steps of: positioning a grooved rotary mandrel mounted on an elongate tie rod within a plain surfaced tube having an elongate axis; positioning an outer annular unit having a plurality of rotary bearing members opposite the rotary mandrel; applying radially inward forces from the rotary bearing unit through the tube to the rotary mandrel thereby swaging and forming an outer spiral-ribbed tube; and simultaneously pulling the outer spiral-ribbed tube away from the rotary mandrel along the elongate axis.

One problem with the second prior art method of making an outer spiral-ribbed tube is that the method is not suitable for making an inner ribbed, outer waved tube. A further problem is that the method is not suitable for making an inner ribbed, outer waved tube composed of a hard metal.

SUMMARY OF THE INVENTION

According to the present invention, an inner spiral-ribbed tube having an outer wave made of a hard metal, such as titanium, titanium alloys, stainless steel, or an iron-nickel alloy containing more than 10% by weight of nickel, is provided by forming a tube of such composition, passing the tube over a special mandrel which forms ribs on the internal surface, simultaneously forming waves on the exterior surface of the tube.

This manufactured hard metal tube includes a cylindrical wall having an inner surface and an outer surface, said inner surface having a plurality of inner spiral ribs and said outer surface having a plurality of outer spiral waves. The outer spiral ribs have a height of about 0.005 to 0.010 inches each, and preferably 0.005 to 0.006 inches. The outer spiral waves have a spiral angle in the range of about 89 to 86 degrees each, and preferably 89 to 88 degrees. The inner spiral ribs and outer spiral waves each has a spiral angle formed by a tangent to a point on the rib and a longitudinal line through the point and parallel to an elongate axis of the tube. The inner spiral angle measures in the range of 8 degrees to 45 degrees, and preferably about 18 degrees.

The method of manufacture of an the inner spiral-ribbed tube according to the invention includes the steps of: positioning a tube over a cylindrical mandrel having a spiral groove; applying radial inward forces through the tube to the mandrel to form inner ribs; applying a radial inward uniform force through the tube to the mandrel to smooth out tube outer surface; and applying radial inward forces through the tube to the mandrel to form tube inner ribs.

The foregoing and other objects, features and the advantages will be apparent from the following description of the preferred embodiment of the invention as illustrated in the accompanying drawing.

DESCRIPTION OF THE PREFERRED EMBODIMENT

Figure 1:
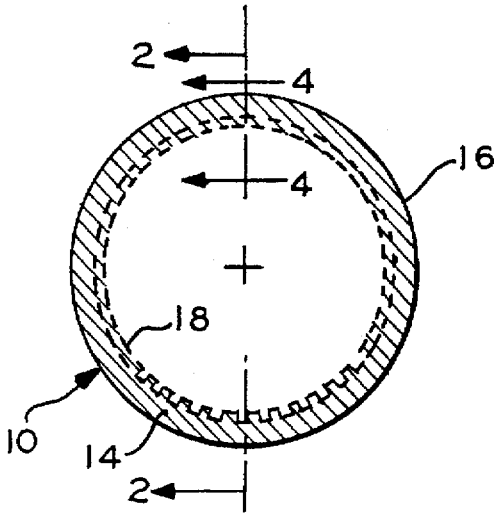
FIG. 1 is a section view of the proposed tube.
Figure 2:
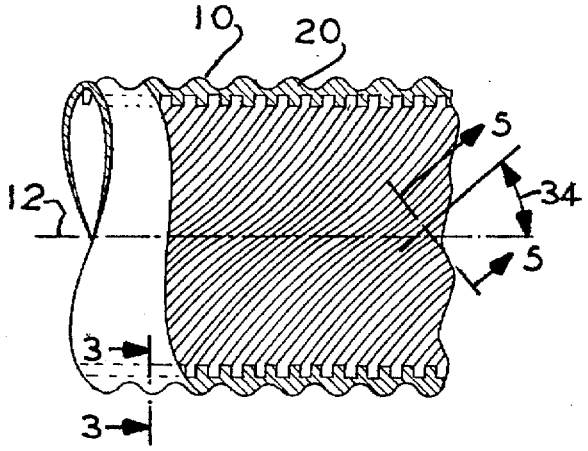
FIG. 2 is a section view as taken along line 2—2 of FIG. 1.
Figure 3:
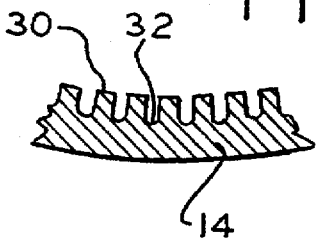
FIG. 3 is a section view as taken along the line 3—3 of FIG. 2.

As shown in FIGS. 1, 2 and 3, a tube 10 is provided. The tube 10 has a tube axis 12 and an annular wall 14. The wall 14 has an outer surface 16 and an inner surface 18. Surfaces 16, 18 are coaxial along the axis 12.

Figure 4:
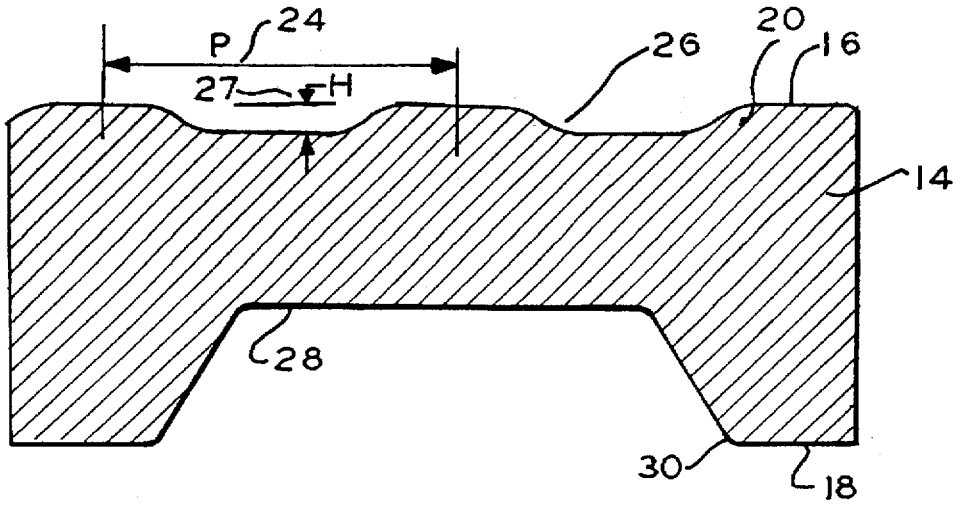
FIG. 4 is a section view as taken along the line 4—4 of FIG. 1.

As shown in FIG. 4, the outer surface 16 has a plurality of outer spiral or helical waves 20, which are separated by respective valleys 26. Each pair of adjacent waves has a uniform wave spacing or pitch 24. Each outer wave 20 has a wave height $H^1$ indicated at 27. The annular wall 14 has a minimum wall thickness 28. Corresponding to the area bounded by the lowest point on a helicon wave and the corresponding depth of the inner spiral rib.

Figure 5:
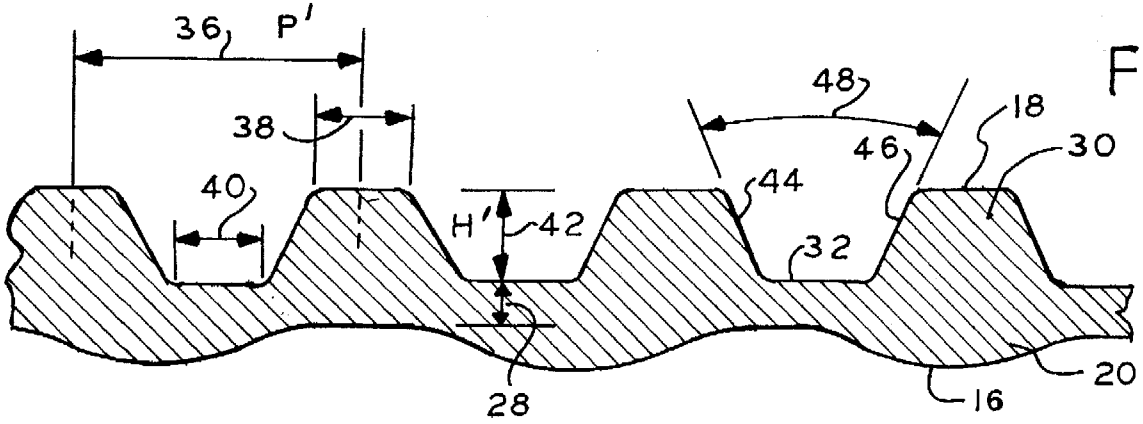
FIG. 5 is a section view as taken along the line 5—5 of FIG. 2.

As shown in FIGS. 2, 3 and 5, the inner surface 18 has a plurality of inner spiral ribs 30. The inner ribs 30 have respective grooves 32 disposed therebetween. The inner rib 30 has a 6 helix or spiral angle 34 (FIG. 2).

As shown in FIG. 5, each pair of the inner ribs 30 has a spacing or pitch $P^1$ indicated at 36. Each of the inner rib 30 has a top width 38. Each of the grooves 32 has a bottom width 40. Each of the rib 30 has a rib height $H^1$ indicated at 42. Each of the grooves 32 has a left and right sloping walls 44, 46. The walls 44, 46 have a groove angle 48 therebetween.

In this embodiment, the tube 10 has an outer diameter of about 0.955 inches. The wall 14 has an overall wall thickness, from wave top to rib top, of about 0.043 inches and a minimum thickness from the wave bottom to the rib bottom. The tube 10 is composed of a hard metal, such as titanium, a titanium alloy, stainless steel, or an iron-nickel alloy containing more than 10% by weight of nickel. The inner surface 28, in section, has about 74 ribs.

The outer wave pitch 24 measures about 0.038 to 0.060 inches, and preferably 0.054 inches; and outer wave height is about 0.005 inches. Minimum wall thickness 28 is about 0.022 to 0.032 inches, and preferably 0.026 inches. Inner spiral angle 34 is in the range of 8 to 45 degrees, and preferably about 18 degrees. Inner rib pitch 36 is about 0.027 to 0.070 inches, and preferably 0.035 inches. Rib top width 38 is about 0.008 to 0.021 inches, and preferably 0.012 inches. Groove bottom width 40 is about 0.0125 to 0.040 inches, and preferably 0.015 inches. Rib height 42 is about 0.008 to 0.016 inches, and preferably 0.012 inches. Inner groove sidewall angle is about 36 degrees.

Figure 6:
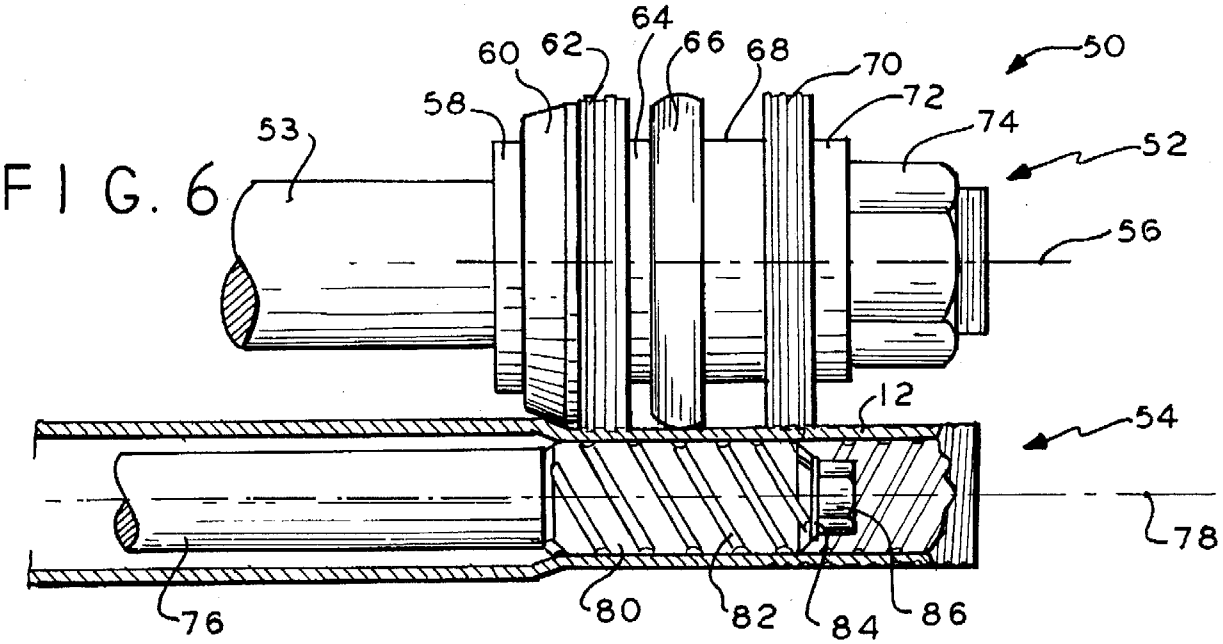
FIG. 6 is a cutaway plan view of the tube and manufacturing tools.
Figure 7:
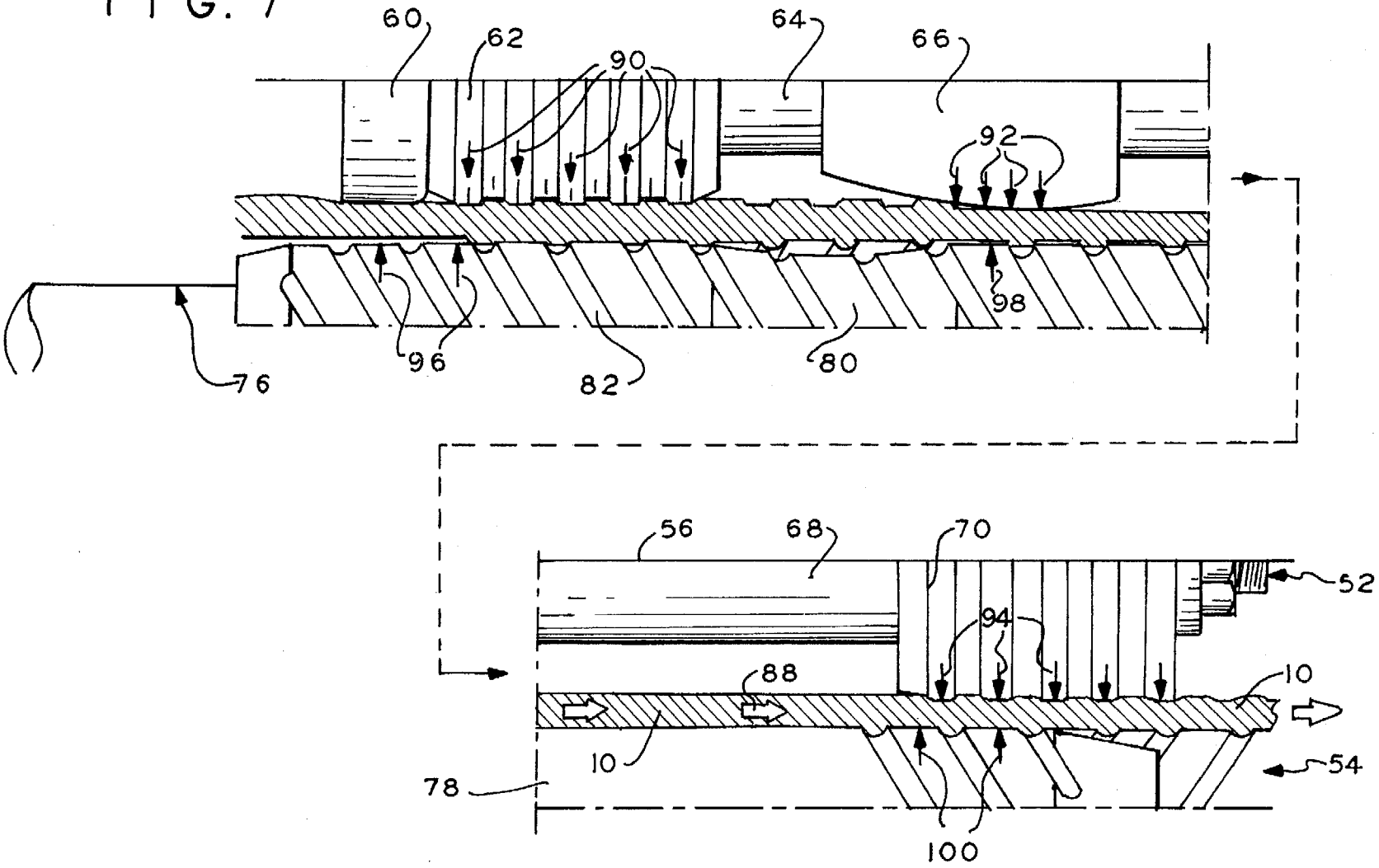
FIG. 7 is an enlarged cutaway plan view of a portion of the tube and manufacturing tools of FIG. 6.

As shown in FIGS. 6 and 7, an apparatus 50 for making the tube 10 is provided. The apparatus 50 has an outer rolling tool subassembly or unit 52 and has an inner spiral mandrel subassembly or unit 54.

The outer subassembly 52 has an outer shaft 53 with an axis 56. The subassembly 52 has an end washer plate 58, a preliminary roll 60 for positioning the tube 10 on the mandrel subassembly 54, and a transport roll 62 for making inner ribs 30. The subassembly 52 also has a first spacer 64, a radius roll 66 for holding down the tube outer surface 16, a second spacer 68, and a wave roll 70 for making the outer waves 20 and the final rib height 42. These rolls of the subassembly 52 are coaxially mounted on shaft 53. The subassembly 52 also has a right end washer plate 72 with a nut 74.

The inner subassembly 54 has an inner shaft 76 with an axis 78. The inner shaft 76 has a mandrel 80, which has spiral grooves 82. The mandrel 80 is fixedly connected but freely rotating to the inner shaft 76. The inner shaft 76 is anchored to the machine base also free rotating. The outer shaft 53 also has pressure means (not shown) for urging the outer subassembly 52 towards the inner subassembly 54. The inner shaft 76 also has a washer plate 84 with a nut 86.

In operation, the tube 10 is pulled in an axial or longitudinal direction 88 along the axis 18. Roll 62 applies axially spaced, radially inward forces 90. Roll 66 applies uniform force 92 in a radially inward direction. Roll 70 applies axially spaced, radially inward forces 94. Forces 90, 92, 94 are applied through the tube 10 to mandrel 80. The mandrel 80 applies respective reaction forces 96, 98, 100 on the tube 10, thus, the roll 62 and the mandrel 80 form inner ribs 30; and the roll 70 and mandrel 80 form the outer waves 20 simultaneously forming the final height 42.

The method or process of manufacture of the tube 10 includes the steps of:

selecting a plain tube composed of relatively hard metal, such as titanium or titanium alloy, or iron-nickel alloy having more than 10% by weight of nickel;

positioning the tube over a cylindrical mandrel having a spiral groove and having a longitudinal axis;

applying radial inward forces through the tube to the mandrel for forming tube spiral inner ribs;

applying a radial inward uniform load through the tube to the mandrel for smoothing out the tube outer surface, but also forcing more tube material into mandrel grooves;

applying radial inward forces through the tube to the mandrel to form tube spiral outer waves; and pulling the tube in an axial direction while applying all of said forces.

In addition, tube 18 may be formed into a convenient size core or roll for shipping to a plant constructing heat exchangers.

In one embodiment of the invention, the tubes can be produced with plain ends, or with lands of standard outside diameter.

The advantages of the tube 10 are indicated hereafter:

A) the tube 10 has a spiral angle of preferably about 18 degrees.

B) The rib 30 permits a relatively high ratio of number of inner fins to tube inner diameter.

C) Tube method of manufacture has a relatively high simultaneous inner rib and outer wave forming speed.

D) The tube 10 has an optimal internal rib geometry which is capable of being manufactured in alloy steels, such as stainless steel, high nickel alloy steel, titanium and titanium alloy.

E) The boiling heat transfer coefficients are three or more times those of a plain tube.

F) The tube 10 has a negligible effect on the two-phase pressure drop of a vertical thermosyphon reboiler since the two-phase static head in the tube dominates the design.

G) The tube 10 can readily be used to replace an existing plain tube in heat exchange apparatus while greatly increasing efficiency.

H) The tube 10 decreases the amount of tubing needed, by about 40% to 50% depending on the applications, resulting in significant cost savings.

I) The tube 10 is cleanable by normal methods used for plain tubes by virtue of the low rib heights and adequate pitch between the ribs and because of the fewer tubes required.

J) The mass velocity of the tube 10 is larger while the inner diameter tube wall temperature is reduced by virtue of the larger boiling coefficient making it particularly useful for temperature sensitive fluids.

While the invention has been described in its preferred embodiment, it is to be understood that the words which have been used are words of description rather than limitation and that changes may be made within the purview of the appended claims without departing from the true scope and spirit of the invention in its broader aspects.

What is claimed is:

1. An inner spiral-ribbed tube for use in a heat exchanger or a refrigerator evaporator comprising:

an annular wall tube having an elongate axis and an inner surface and an outer surface and consisting of a hard metal material selected from the group consisting of titanium, titanium alloy, stainless steel, and an iron-nickel alloy containing more than 10% by weight of nickel;

said inner surface having a plurality of inner spiral ribs having a top and a bottom covering the entire inner surface of the tube and extending along the tube axis having a rib height of about 0.008 to about 0.016 inches, a width between the base of each rib of about 0.0125 to 0.040 inches, a width between the top of each rib of about 0.008 to 0.021 inches, and a pitch of about 0.027 to 0.070 inches, and said inner spiral ribs each having a spiral angle formed by a tangent to a point on the rib and a longitudinal line through the point and parallel to the elongate axis of the tube of between 8 to 45 degrees, and said outer surface having a plurality of outer spiral waves extending along the tube axis having a wave height of about 0.005 to 0.010 inches, a wave pitch of about 0.038 to 0.060 inches and a spiral angle of about 86 to 89 degrees.

2. The tube of claim 1, wherein the rib height is about 0.012 inches and the wave height is about 0.005 inches and the inner spiral angle is about 18 degrees.

3. The tube of claim 1, wherein the tube has plain ends.

4. An inner spiral-ribbed tube for use in a heat exchanger or a refrigerator evaporator comprising:

an annular wall tube having an elongate axis having an inner surface and an outer surface and consisting of a hard metal material selected from the group consisting of titanium, titanium alloy, stainless steel, and an iron-nickel alloy containing more than 10% by weight of nickel;

said inner surface having a plurality of inner spiral ribs having a top and a bottom covering the entire inner surface of the tube and extending along the tube axis having a rib height of about 0.012 inches, a width between the base of each rib of about 0.015 inches, a width between the top of each rib of about 0.012 inches, and a pitch of about 0.035 inches, and said inner spiral ribs each having a spiral angle formed by a tangent to a point on the rib and a longitudinal line through the point and parallel to the elongate axis of the tube of 18 degrees, and said outer surface having a plurality of outer spiral waves extending along the tube axis having a wave height of about 0.005 to 0.006 inches, a wave pitch of about 0.056 inches and a spiral angle of about 88 to 89 degrees.

* * * * *